US005370460A

United States Patent [19]

Nelson

[11] Patent Number: 5,370,460

[45] Date of Patent: Dec. 6, 1994

[54] RECREATIONAL/PLAY MAT-CONVERTIBLE TO A TOTABLE STORAGE BAG

[76] Inventor: Carol J. M. Nelson, 3972 Lewiston Rd., Summerfield, N.C. 27358

[21] Appl. No.: 169,369

[22] Filed: Dec. 20, 1993

[51] Int. Cl.[5] ..... B65D 30/00; A45C 9/00

[52] U.S. Cl. ..... 383/4; 5/417

[58] Field of Search ..... 383/4; 5/417; 224/151

[56] References Cited

U.S. PATENT DOCUMENTS

| | | | |
|---|---|---|---|
| 1,269,276 | 6/1918 | Harris | 383/4 |
| 2,667,353 | 1/1954 | Lanice | 383/4 X |
| 4,197,891 | 4/1980 | Comollo | 383/4 |
| 4,671,393 | 6/1987 | Rainey | 383/4 X |
| 4,886,150 | 12/1989 | Fitzsimmons | 383/4 X |

FOREIGN PATENT DOCUMENTS

| | | | |
|---|---|---|---|
| 2047548 | 4/1971 | Germany | 383/4 |
| 0527667 | 10/1940 | United Kingdom | 383/4 |

*Primary Examiner*—Allan N. Shoap
*Assistant Examiner*—Jes F. Pascua

[57] ABSTRACT

The object of this invention is to provide a versatile recreational mat that can be folded easily into a totable storage bag. This is accomplished by the use of six precisely placed handles, three on either side of the mat. First, the two outside handles on either side of the mat are superimposed over the respective center handle on the same side of the mat. The article is then folded in the middle so that the two sets of three handles may be fastened together; thus creating a totable storage bag for transport, but without the numerous zippers and fasteners that interfere with the mat's surface in existing mat/-bag combinations. This invention may also include a printable surface offering many play and game possibilities; such as, but not limited to roads for cars, towns for inhabitants, or templates for board games. Pockets may also be included for specific recreational items: such as, but not limited to toys, game pieces, garden tools etc., such that the items can be retained in place for storage or transport while in the bag configuration. The process of unfolding the bag to a mat is also easily accomplished without removing such items from the bag.

1 Claim, 2 Drawing Sheets

RECREATIONAL/PLAY MAT-CONVERTIBLE TO A TOTABLE STORAGE BAG

BACKGROUND OF THE INVENTION

1. Field of the Invention

This invention relates to a recreational mat which folds into a carrying bag unit.

2. Prior Art

As a mother of four I have spent a considerable amount of time gathering toys and game pieces from the floor of my home. If we visited neighbors or attended family outings, we had to take the toys with us and try to gather them up when it was time to leave. Anyone who has had children around can relate to these situations. When our children were in pre-school we would spread a blanket or bed sheet in the middle of the floor to provide the children with a smooth clean surface on which to play and put toys on the blanket for entertainment. We would pull the blanket up by its four comers to hold the toys until the next time. This solution was inconvenient as a means of storage or for transporting and tracking the toys at someone else's house, at a park or at the beach. Other parents attempt to solve the problem by throwing the toys into a basket or toy box, or simply restricting them to a room that is 'off limits' to visitors.

As the children grew, they went from stuffed animals to Barbies, blocks to Legos, and from there to jigsaw puzzles, board games and card games. As the toys became more challenging and unstable containers (e.g. boxes) were essential for their storage and transport, missing game or puzzle pieces, doll accessories etc became a serious problem.

Commercially available solutions to this problem are inadequate. In toy stores, one can buy a small mat/quilt with play articles attached, designed for very young babies (Fold 'N Go Activity Quilt; Playskool Inc.). The mat folds and fastens with a button in one corner in order to fit conveniently into, e.g. a diaper bag In the folded form, this mat does not, however, create a suitable bag for storing or transporting other toys.

Most mat/utility bag combinations found in the patent search are designed with numerous zippers and fastners. Some provide additional carrying space, but do not permit articles to remain on the mat during conversion (U.S. Pat. Nos. 1,951,527, 3,976,113, 4,468,810, 4,489,815 and 5,110,219)). Other mat/bag combinations are folded for self-storage or transport, but provide no additional carrying space inside (U.S. Pat. No. 4,164,275). The items in U.S. Pat. Nos. 2,479,203 and 4,738,515 both provide draw strings that allow the items to remain on the mat for transport; however, it requires significant effort to flatten the bag into a mat, and strength to convert the mat back to a bag. The draw string also presents a safety hazard for younger children. Finally, a blanket that folds into a pillow and is carried with a strap was found in the McCall's pattern book during a review of available fabric patterns. It did not form a carrying bag.

The invention described herein is a recreational mat/-totable storage bag. As a bag, it is held conveniently by six handles which are held together by a tab/fastener. When the invention is in the folded configuration, and is held in an upright position using the handles, contents of the bag are retained within. The bag is easily unfolded into a mat or refolded into a bag with the articles in the middle. Further, the inside surface of the mat may be imprinted with a game or design to stimulate the child's imagination, or to serve as a game board. A variation of the mat/totable storage bag could be used to store and/or transport gardening equipment, beach paraphernalia etc.

SUMMARY OF INVENTION

The object of this invention is to provide a versatile recreational mat that can be folded easily into a totable storage bag. This is accomplished by the use of six precisely placed handles, three on either side of the mat. First, the two outside handles on either side of the mat are superimposed over the respective center handle on the same side of the mat. The article is then folded in the middle so that the two sets of three handles may be fastened together; thus creating a totable storage bag for transport, but without the numerous zippers and fasteners that interfere with the mat's surface in existing mat/-bag combinations. This invention may also include a printable surface offering many play and game possibilities; such as, but not limited to roads for cars, towns for inhabitants, or templates for board games. Pockets may also be included for specific recreational items; such as, but not limited to toys, game pieces, garden tools etc., such that the items can be retained in place for storage or transport while in the bag configuration. The process of unfolding the bag to a mat is also easily accomplished without removing such items from the bag.

DETAILED DESCRIPTION OF THE INVENTION

Figure 1:
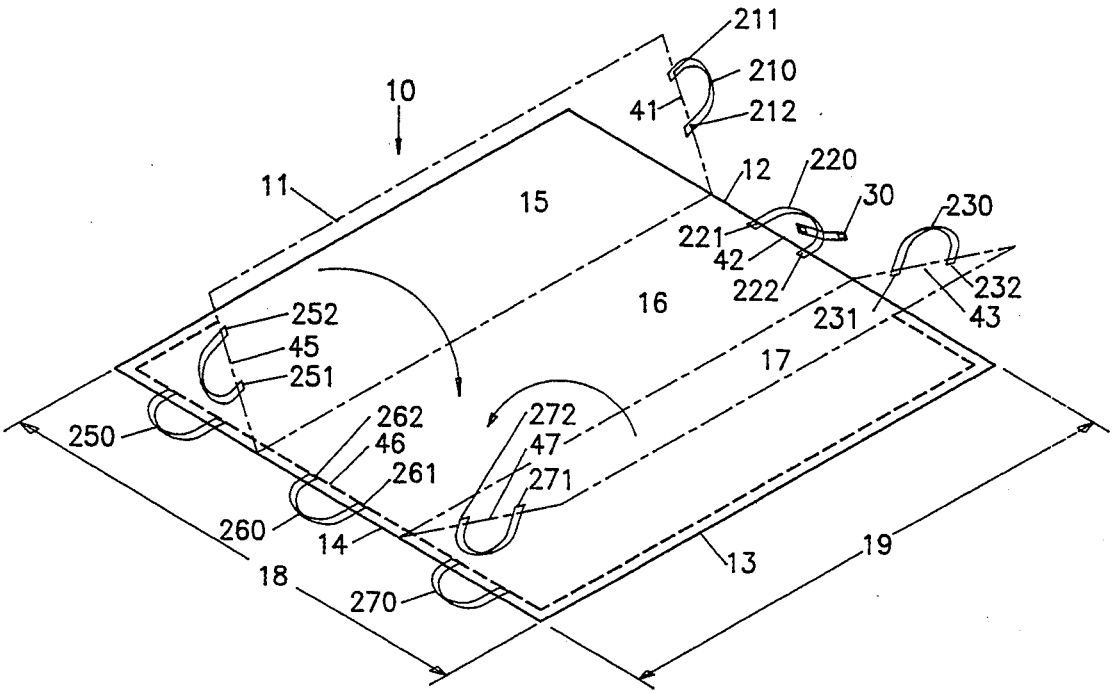
FIG. 1 is a perspective view illustrating the process of converting from the flat mat to a totable storage bag through the first and second folds.
Figure 2:
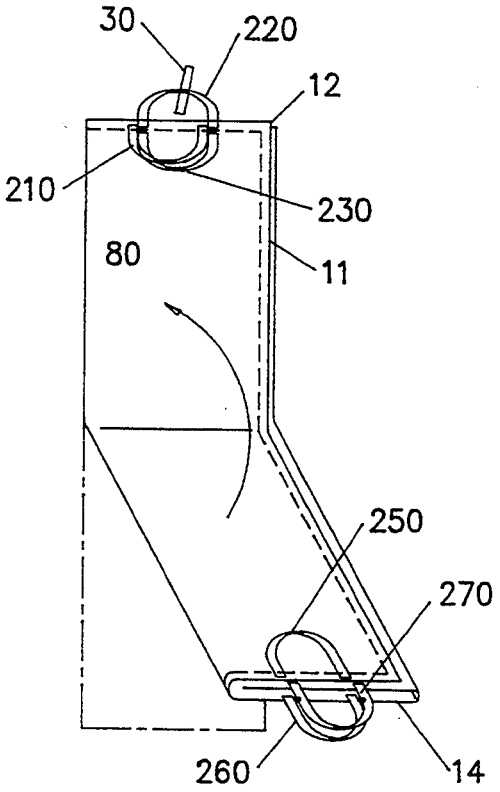
FIG. 2 is a perspective view of the third and final fold to form the totable storage bag.
Figure 3:
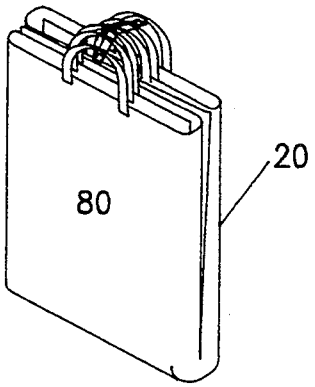
FIG. 3 is a perspective view of the totable storage bag configuration, with the tab going through handles, but not yet fastened

The key to the invention is the conversion of rectangular mat 10 (see FIG. 1), comprised of foldable material which may be printable or non-printable, to a totable storage bag 20, as shown sequentially in FIGS. 1, 2 and 3. The conversion is accomplished by superimposing six, strategically placed handles (210, 220, 230, 250, 260 and 270), three on opposite sides 12 and 14 of the flat mat. The first center handle 220, which includes the tab 30, should be placed so that the center 32 of the handle 220 is at the middle 42 (length 18 of the side 12 divided by two) of side 12 of the mat 10, with the ends 221 and 222 of handle 220 fastened to the outer edge of side 12 of the mat 10. The second center handle 260 (without a tab) is placed in the middle 46 of the opposite side 14 of the mat 10. The center handles 220 and 260 should be attached to the mat 10 so their respective ends (221, 222, 261 and 262) are at approximately an equal distance from the nearest end 11 or 13 of the mat 10. To determine the placement of the outside handles 210, 230, 250 and 270 on either side 12 or 14 of the respective center handles 220 or 260, it must be recognized that the center section 16 of the mat 10 (including the center handles 220 and 260), which is created following the first and second folds of the mat 10 (shown in FIG. 1), should be approximately 1 inch larger than the other two sections 15 and 17, in order to permit them to lie smoothly inside the storage bag. Given this difference between the center 16 and outside sections 15 and 17 of the mat 10, the distance from the ends 11 or 13 of the mat 10 to the respective midpoint,; 41, 43, 45, and 47 of each of the outside sections 15 and 17 can be determined as follows: length 18 of the mat 10 minus one inch, divided by 6. The ends 211, 212, 231, 232, 251, 252, 271 and 272 of individual handles 210, 220, 230, 250, 260 and 270 may be set approximately 3 to 5 inches apart depending upon the size of the handle aperature desired for the application. All handles 210, 220, 230, 250, 260 and 270 should be the same size and should have their ends 211, 212, 221, 222, 231, 232, 251, 252,261, 262, 271 and 272 set the same distance from their respective midpoints 41, 42, 43, 45, 46 and 47.

The handles 210, 220, 230, 250, 260 and 270 shown in FIG. 1 may be made of any material suitable for handles; such as, but not limited to textiles, plastics or other suitable materials. The width 51 of the handles 210, 220, 230, 250, 260 and 270 should preferrably be 0.5 to 1.5 inches for carrying comfort. The length 61 of the handles may also vary with the size of the mat 10/totable bag 20; approximately 7 inch handles provide adequate length for ease in carrying, though longer handles may be desireable for some applications. The handles 210, 220, 230, 250, 260 and 270 should be placed on the longer side of the mat if it is rectangular, and sewn in place or fastened with rivets or other fasteners appropriate for the material chosen.

Figure 4:
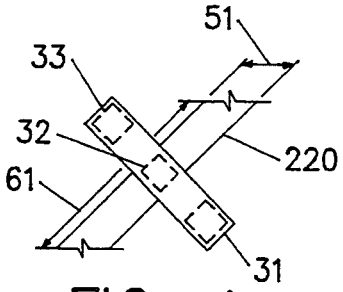
FIG. 4 is enlarged detail of the small tab attached to one of the center handles.

A tab fastener 30, which can be made of the same materials as the handles, will be attached to the middle 32 handle 22, as shown in FIG. 4. The tab 30 may be sewn or riveted depending on the material being used for the handles. The ends 31 and 33 of tab 30 could be fastened to one another utilizing a variety of fasteners including, but not limited to snaps, button and button holes or hook and loop fasteners sold, under the trademark VELCRO. This tab 30 will hold all six handles 210, 220, 230, 250, 260 and 270 in place, which will hold all sections in their upright position when the bag 20 is carried or stored by the handles 210, 220, 230, 250, 260 and 270.

A binding may be added to the mat 10 edges 11, 12, 13 and 14, if the materials used require the edge to be finished, before or after attaching the handles, depending on the type of material used for the handles and whether one wishes the binding to be attached over the handle ends 210, 212, 221, 222, 231, 232, 251, 252, 261, 262, 271, and 272. FIGS. 1 and 2 illustrate the sequential steps during the formation of the totable storage bag 20, shown in FIG. 3, from the mat 10 shown in FIG. 5. The totable storage bag 20 in FIG. 3 is shown without the tab 30 fastened. The totable storage bag 20 configuration (as shown in FIG. 3) will be approximately one-sixth the size of the mat 10, so the respective areas of the mat 10 and bag 20 may be adjusted proportionately. The bag 20 will be approximately one-third the length 18 and one-half the width 19 of the mat.

The underside 80 of the mat 10 in FIG. 1 forms the outside 80 of the totable storage bag 20. The topside sections 15, 16 and 17 of the mat 10 forms the inside of the totable storage bag 20: thus only the underside 80 of the mat 10 is exposed to the outside 80 of the totable storage bag 20 configuration. Consequently, pockets 301 could be attached to the topside sections 15, 16 and 17 of the mat 10 to retain various items in a particular location within the totable storage bag 20. Items lying on the mat 10 may be folded into the bag 20 without removing the items from the mat 10. Items may also be dropped into the top of the totable storage bag 20 after the mat 10 has been folded and the handles 210, 220, 230, 250, 260 and 270 are joined. Conversely, items may be left in the totable storage bag 20 while it is being unfolded into the mat 10 configuration.

Figure 5:
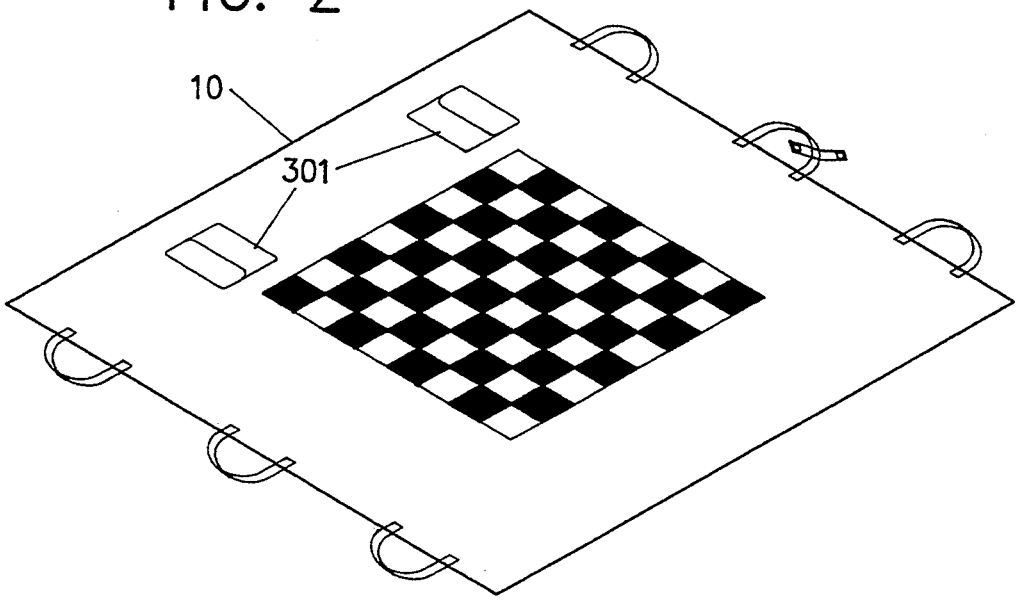
FIG. 5 is a perspective view of the mat imprinted with a game board, with pockets.

In the mat 10 configuration illustrated by FIG. 5, the body member serves as a flat mat upon which a person may sit, lie, or conduct a recreational activity. Thus, the foldable, printable or non-printable material of the body member may be chosen from one of a large variety of materials including, but not limited to plastics or various single density or quilted textiles, or canvas for larger mats and outdoor use. The capability to utilize practically any foldable sheet-like material within the scope of the invention is a strength in its design, since it permits one to elect the material according to the individual activity for which the mat 10/totable storage bag 20 combination is required: from an infant play mat or printed game board 310, to a waterproof mat for gardening or beach use.

Having described the invention, what I claim is:

1. A combination mat/totable storage bag comprising:

a rectangular flat sheet of foldable material defining opposed sides and ends of said mat;

six equally sized handles, each handle having a midpoint, three of which are attached along one side of the mat with the remaining three handles attached at equivalent locations on the opposed side of said mat;

the three handles on each side of the mat defining a center handle and two outside handles with the midpoint of each center handle equidistant from the ends of said mat and the midpoint of each outside handle located at a distance from a respective end of said mat equal to the total length of the side of said mat minus one inch, divided y six;

wherein a totable storage bag configuration is achieved by folding said mat into thirds along two lines perpendicular to the sides and superposing the outside handles upon the center handles, and then folding said mat along a line parallel to the sides to superpose the six handles upon each other, thus defining two compartments into which items may be placed and removed; and one of the center handles including a tab having fasteners for maintaining the six handles together when said mat is in its totable storage bag configuration.

* * * * *